US005170983A

United States Patent [19]

Stewart

[11] Patent Number: 5,170,983

[45] Date of Patent: Dec. 15, 1992

[54] BOOKHOLDER WITH CONVERTIBLE BASE FOR DUAL SUPPORT MODES

[76] Inventor: Richard M. Stewart, 236 Central Rd., Middlebury, Conn. 06762

[21] Appl. No.: 858,484

[22] Filed: Mar. 27, 1992

[51] Int. Cl.[5] ..... F16M 13/00

[52] U.S. Cl. ..... 248/558; 248/449; 248/451; 248/460

[58] Field of Search ..... 248/444, 448, 451, 452, 248/470, 471, 447.1, 449, 455, 535, 558, 126, 465.1, 460, 454, 453

[56] References Cited

U.S. PATENT DOCUMENTS

| | | | |
|---|---|---|---|
| 197,763 | 12/1877 | Clarke | 248/454 |
| 1,029,668 | 6/1912 | Clark | 248/444 |
| 1,598,569 | 8/1926 | Fitzhugh . | |
| 1,797,847 | 3/1931 | Vandagriff . | |
| 2,255,632 | 9/1941 | Stevens | 248/454 |
| 2,448,734 | 9/1948 | Phillips | 45/82 |
| 3,351,312 | 11/1967 | Ballas | 248/448 |
| 3,799,488 | 3/1974 | Sena | 248/126 |
| 3,863,882 | 2/1975 | Hatcher | 248/453 |
| 4,191,354 | 4/1980 | Chia-Liu | 248/45 |
| 4,455,008 | 6/1984 | Mackew . | |
| 4,465,255 | 8/1984 | Hill | 248/441.1 |
| 4,553,728 | 11/1985 | Corsello | 248/452 |
| 4,871,139 | 10/1989 | Loewke et al. | 248/451 X |
| 4,896,252 | 1/1990 | Stewart . | |
| 4,907,777 | 3/1990 | Stewart . | |
| 4,998,703 | 3/1991 | Stewart . | |

FOREIGN PATENT DOCUMENTS

| | | | |
|---|---|---|---|
| 409829 | 3/1934 | United Kingdom | 248/452 |
| 444203 | 3/1936 | United Kingdom | 248/454 |

*Primary Examiner*—David L. Talbott
*Attorney, Agent, or Firm*—William C. Crutcher

[57] ABSTRACT

A bookholder with a base member having a longitudinally extending base portion forward from a U-shaped rod defining a first planar surface; a support member having a longitudinally extending support portion formed from another U-shaped rod defining a second planar surface; a book carrier mounted on the support member having book-supporting ledges; and a transverse coupling member with pairs of holes arranged to receive and hold both the base portion rod and the support portion rod so the first and second planar surfaces intersect at a preselected included angle. The book carrier is movable along the support member to adjust the height of the book carrier with respect to the coupling member. The base member rod is movable with respect to the coupling member between a first "suspending mode" position when the selected included angle is approximately between 90° and 130°, into a second "table supporting mode" position when the selected included angle is between 90° and 50°.

7 Claims, 3 Drawing Sheets

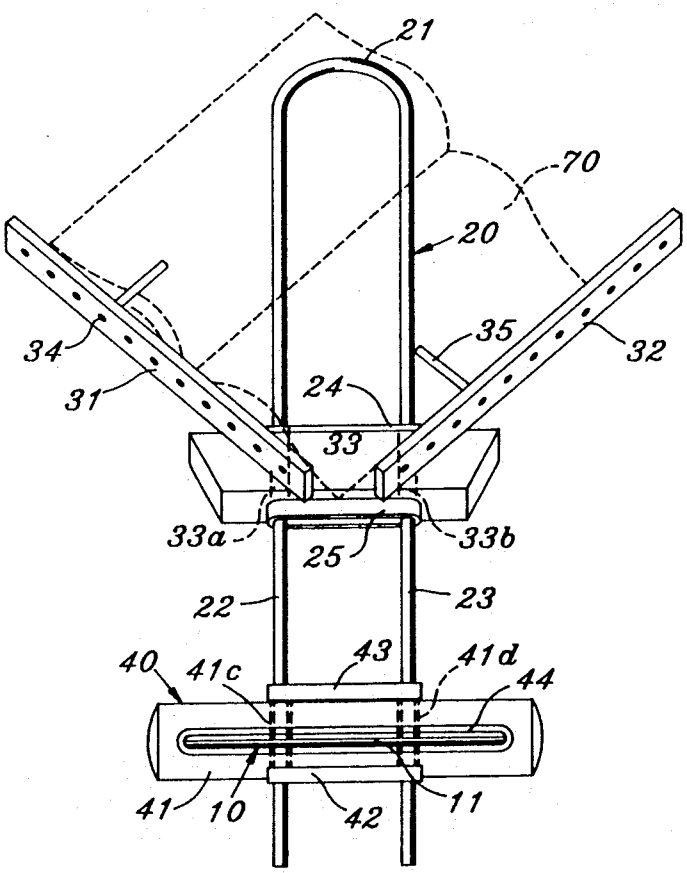
Fig. 1
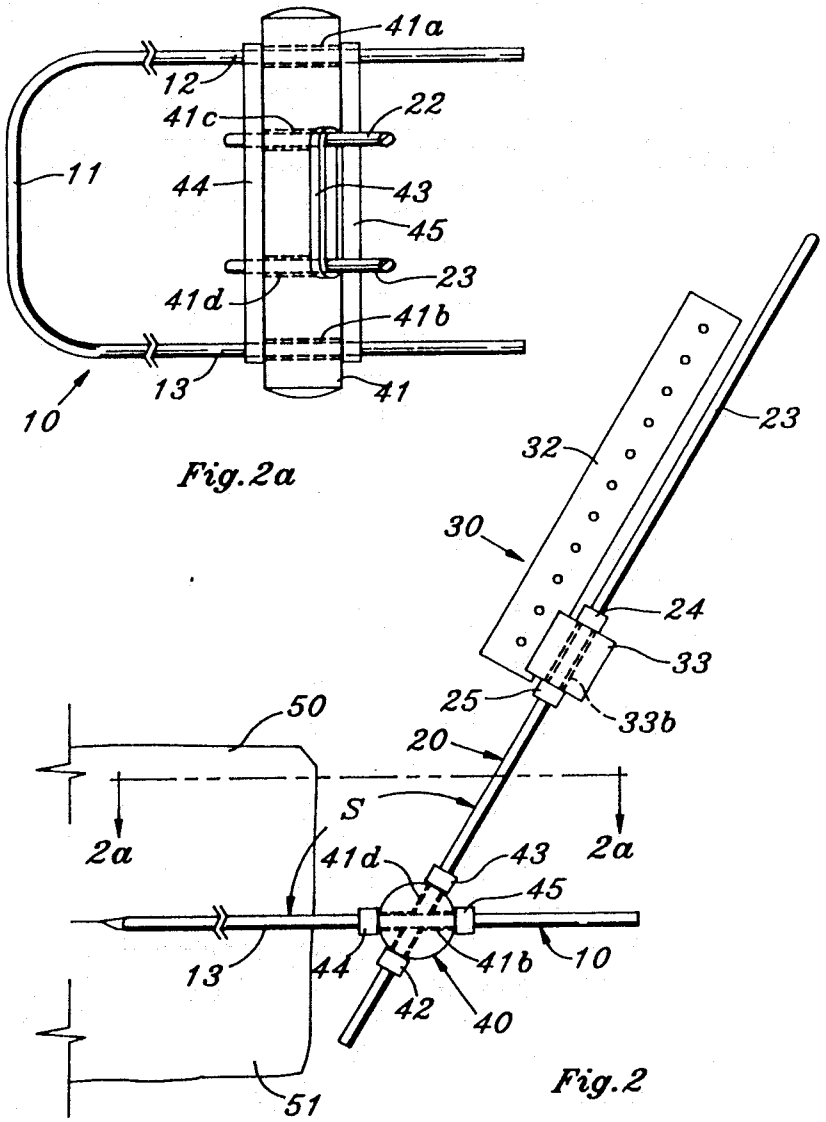
Fig. 2a
Fig. 2

BOOKHOLDER WITH CONVERTIBLE BASE FOR DUAL SUPPORT MODES

BACKGROUND OF THE INVENTION

This invention relates generally to bookholders and more particularly to bookholders for reading in bed from an inclined position, which are also adaptable to other uses. A great deal of attention has been devoted in the prior art to reading in bed. Various arrangements to facilitate inclined reading are shown in U.S. Pat. No. 4,191,354 to Su Chia-Liu dated Mar. 4, 1980; U.S. Pat. No. 3,351,312 to Ballas dated Nov. 7, 1967 and my own U.S. Pat. Nos. 4,896,252 dated Jan. 23, 1990; 4,907,777 dated Mar. 13, 1990 and 4,998,703 dated Mar. 12, 1991.

Such bookholders are usually either adapted to be suspended from a bracket on its associated furniture, or to rest on a table. My patents above are exemplary of tabletop bookholders.

Phillips U.S. Pat. No. 2,448,734 illustrates a bookholder frame disposed on rods attached to a clamp on the bedstead, while Fitzhugh U.S. Pat. No. 1,598,569 issued Aug. 31, 1926 and Vandagriff U.S. Pat. No. 1,797,847 issued Mar. 24, 1931, both show bookholder brackets attached to the side rail of a bed. U.S. Pat. No. 4,465,255 to Hill shows a bookholder, including a flat base member which is inserted between the mattress and the box spring of a bed. The foregoing arrangements are suitable for attachment to beds, but are rather limited for other uses because of their construction.

MacKew U.S. Pat. No. 4,455,008 dated Jun. 19, 1984, has disclosed a modular arrangement for a bookholder which can either be suspended from brackets attached to furniture or can function as a freestanding desk or tabletop unit. A plurality of different support mechanisms are required for attachment to the module in order to provide different support modes.

It would be desirable to achieve a bookholder with a minimum number of parts and of inexpensive construction suitable for inclined reading in bed. Further, it would be desirable to utilize the same elements in order to support the bookholder in different modes of use.

Accordingly, one object of the present invention is to provide an improved bookholder which is suitable for different modes of support without the addition of parts.

Another object of the invention is to provide an improved bookholder which is suitable either for support from a bed or for use on a table top.

Still another object to the invention is to provide an improved bookholder which is economical, easy to use and adaptable to a number of different reader and book support situations.

SUMMARY OF THE INVENTION

Briefly stated, the invention comprises a base member having a longitudinally extending base portion defining a first planar surface; a support member having a longitudinally extending support portion defining a second planar surface; a book carrier mounted on the support member having book-supporting ledges; and a transverse coupling member arranged to receive and hold both the base portion and the support portion so the first and second planar surfaces intersect at a preselected included angle. The book carrier is movable along the support member to adjust the height of the book carrier with respect to the coupling member. The base member is movable with respect to the coupling member between a first "suspending mode" position when the selected included angle is approximately between 90° and 130°, into a second "table supporting mode" position when the selected included angle is between 90° and 50°. In the preferred embodiment, the base member and the support member both comprise U-shaped rods, the book carrier comprises a crosspiece with ledges fixed thereon, and the coupling member comprises a transverse dowel with pairs of holes to receive the U-shaped rods. The base member U-shaped rod is slid through holes in the coupling member to alternate extended positions on opposite sides of the coupling member to provide the two support modes.

DRAWING

The invention, both as to organization and method of practice, together with further objects and advantages thereof, will best be understood by reference to the following specification, taken in connection with the accompanying drawings, in which:

FIG. 1 is a front elevational view of the improved bookholder,

FIG. 2 is a side elevational view of the improved bookholder illustrated in the suspended support mode, FIG. 2*a* is a partial top plan view, taken along lines A—A of FIG. 2, FIG. 3 is a second side elevational view of the same bookholder which has been converted to the table supporting mode, FIG. 4 is a front elevational view of a modified form of the invention, and FIG. 5 is a perspective view of another modified form of the invention.

DESCRIPTION OF THE PREFERRED EMBODIMENT

Figure 4:
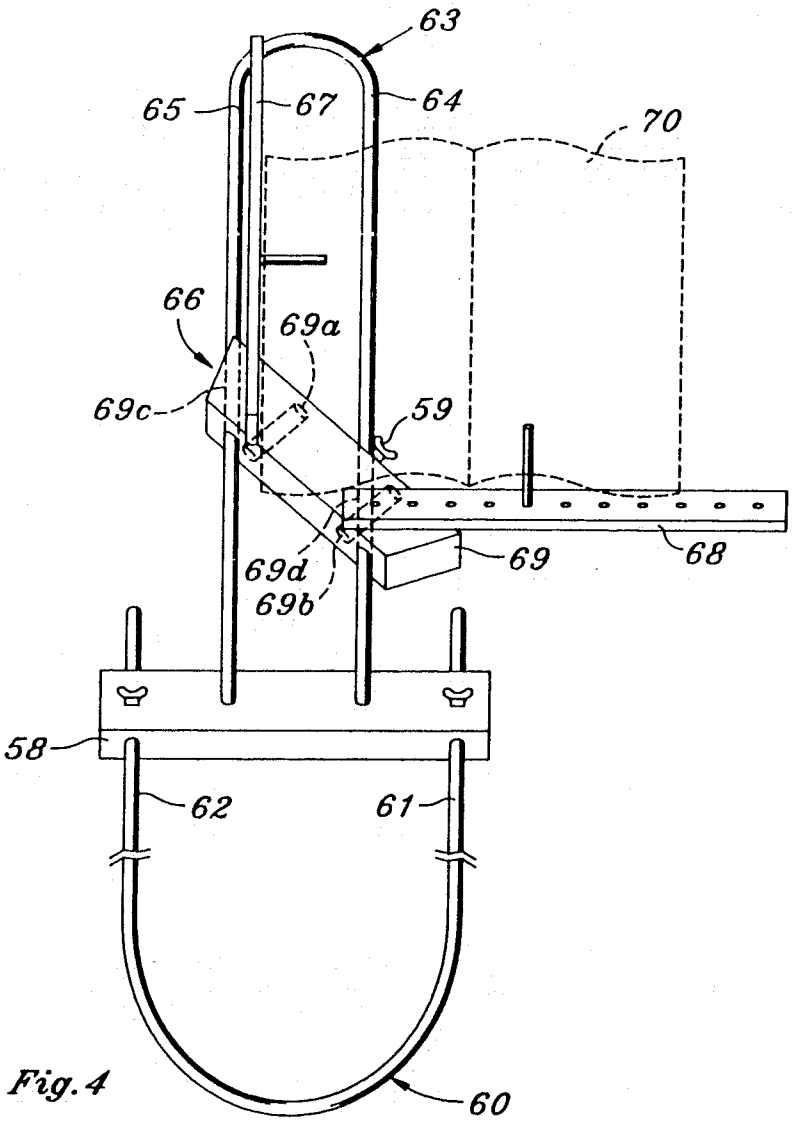

Referring now to FIGS. 1, 2, and 2*a* of the drawing, my improved bookholder comprises four separable components, together with suitable means to lock the components in a fixed position with respect to one another. The major components include a base member shown generally at 10, a support member shown generally at 20, a bookholder member shown generally at 30, and a transverse coupling member shown generally at 40.

The base member 10 in its preferred embodiment is a U-shaped rod made up of a central lateral portion 11 and two transversely spaced, longitudinally extending straight arms 12, 13. The two legs 12, 13, being spaced apart by the central piece 11 and the coupling member 40 in a manner to be described, together define a first planar surface. The rods may be of relatively small diameter and constructed or bent from any suitable material such as plastic or metal.

In a similar type of construction, the support member 20 comprises a narrower U-shaped rod which may be of the same material as the base member. Support member 20 includes a shorter central lateral piece 21 together with two transversely spaced longitudinally extending substantially straight arms 22, 23. The spaced arms together make up a longitudinally extending support portion defining a second planar surface.

While the members, 10 and 20 may simply be bent from a single piece of rod or tube, they may also be welded or otherwise attached together, and can also include more than two legs. The word rod, when used herein is intended to include tube as well, as and is not limited to a round cross section, but may include any solid or hollow shape, extruded, rolled, drawn or cast.

The book carrier 30 includes a pair of ledges 31, 32, which are fixedly mounted to a cross member 33 and extending substantially perpendicular to the planar surface formed by the legs 22, 23 when the cross member is held on the support member 20. Each of the ledges, 31, 32 is provided with suitable holes 34 and preferably transparent dowels 35. In this manner, a book, shown in phantom lines 70, may have its edges supported on ledges 31, 32 with its back resting on the planar surface formed by the support member 20. The ledges are at 90° angles and tilted 45° to the horizontal for inclined reading as described in my aforementioned patents in a first reading orientation. The cross piece 33 includes parallel holes 33*a*, 33*b* of slightly larger diameter than that of the arms 22, 23, so that the book carrier 30 will be movable vertically along the support member 20. The purposes of this is to adjust the height of the bookholder.

Suitable means are provided to fix the cross piece at a selected position. Many suitable means are available, such as thumb screws and the like. A very simple arrangement is through the use of thick elastic bands 24, 25 stretched and placed around the tube legs 22, 23. Any attempt to slide the cross piece 33 up or down after placement of the bands will be met with resistance to movement. I have found that this is quite a satisfactory method of fixing the bockholder 30 with respect to the support member 20, although many other fixing means are available.

Lastly, the transverse coupling member 40 is arranged to receive and hold both the base member 10 and the support member 20 so that the first and second planar surfaces intersect one another at a selected included angle. One manner of doing this in the preferred embodiment is to utilize a large diameter dowel 41 for the coupling member and to provide a first set of parallel holes 41*a*, 41*b* at suitable spacing and diameter to slidably receive the two base legs 12, 13 and to provide a second pair of holes 41*c*, 41*d* of suitable spacing and diameter to slidably receive the two support legs 22, 23.

In a manner similar to the locking arrangement previously described, each of the slidable elements may be adjusted and locked in place by elastic bands 42, 43 in the case of the support member and 44, 45 in the case of the base member.

Referring now to FIGS. 2 and 2*a* of the drawing, it will be seen that the base member has been slid in the transverse coupling member holes 41*a*, 41*b* all the way to the left. The axes of the holes in the transverse coupling member are such as to hold the base member 10 with respect to support member 20 so that a selected included angle S is defined at the intersection of the planar surfaces. FIGS. 2 and 2*a* illustrate the "suspending mode" of the bookholder. The planar surface formed by the longitudinally extending portion of the base member is inserted between a mattress and a box spring or the like shown generally at 50, 51 respectively. The weight of the mattress prevents the natural tendency of the bookholder 30 and support member 20 to tip over (clockwise in the drawing).

Figure 3:
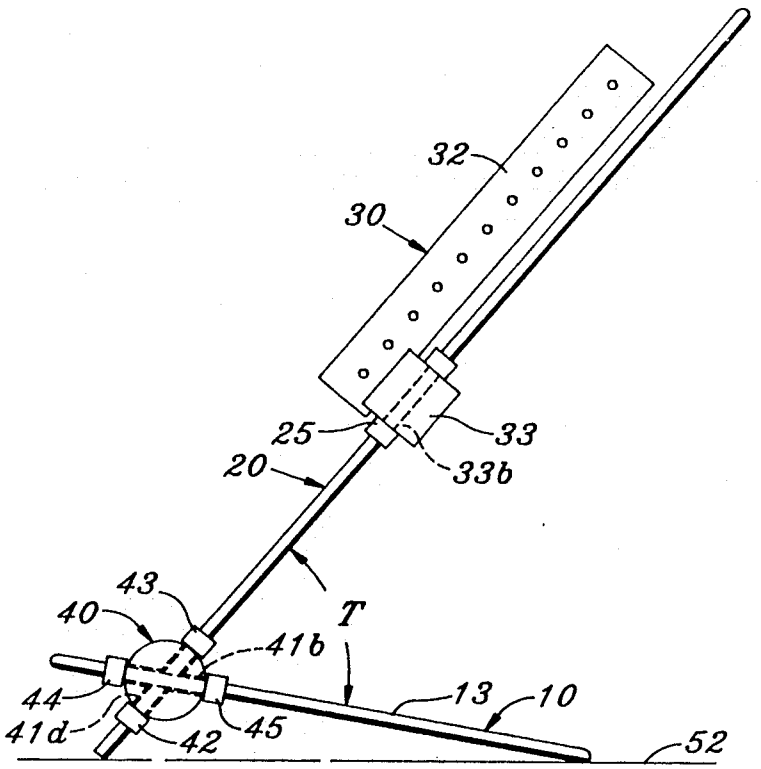

FIG. 3 of the drawing shows the bookholder in the second or table-top mode with the base member 10 slid all the way to the right. In this case now, the included angle T is the complement of the previous angle S. Since the weight of the bookholder 30 is again trying to rotate the device clockwise, the longitudinally extending portion formed by legs 12, 13 prevents tipping. Legs 12, 13 are now be employed on their other ends to support the bookholder in the proper position on a table indicated generally at 52.

The selected included angle S is preferably about 110° and the complementary included angle T is accordingly about 70°. However, a range of suitable angles exist and it is suitable for S to lie in a range between 90° and 130° while complementary angle T may lie in a range of between 90° and 50°, respectively.

Figure 5:
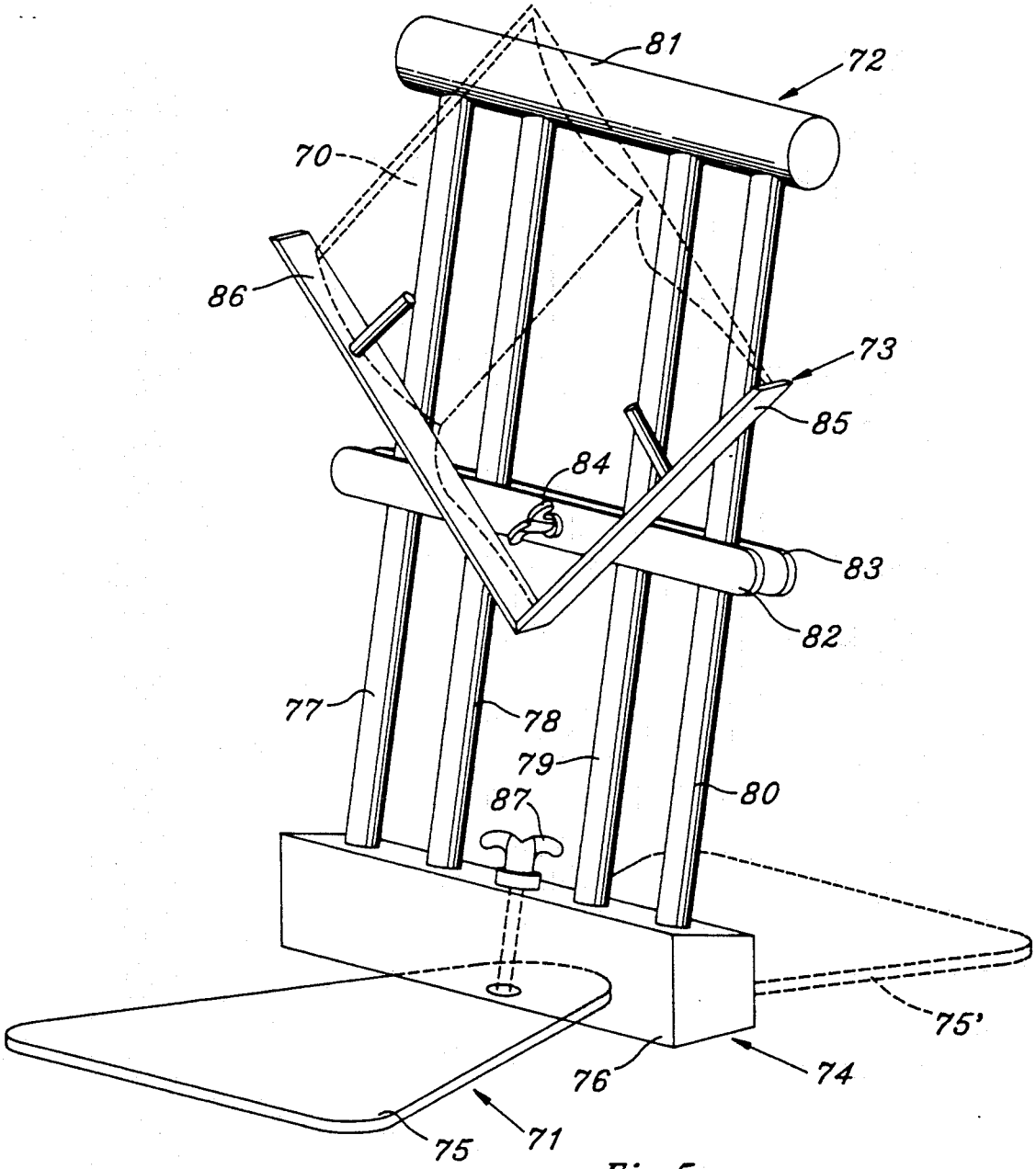

Referring now to FIGS. 4 and 5 of the drawing, other modifications are shown to illustrate the versatility of the invention.

Referring to the view of FIG. 4, which is drawn as a part plan, part elevation, view so as to illustrate both the base and support member, a number of variations in construction are illustrated, which may be useful. A base member 60 comprises a rod as before, in the shape of a U, with legs 61, 62 and transverse member 58. A support member 63 also comprises a rod which includes parallel, laterally spaced longitudinally extending legs 64, 65. The bookholder, shown generally at 66 is similar to that previously described, with two ledges 67, 68 fixed to a cross piece 69. However, in addition to the two pairs of holes 69*a*, 69*b* arranged as previously described to hold the book at 45° for inclined reading, an additional pair of holes 69*c*, 69*d* are provided. Hole 69*c* and 69*d* run parallel with one of the ledges 67 and perpendicular to the other ledge 68. In this manner, a book 70 may be supported on one of the ledges in the normal upright position in a second reading orientation as indicated in phantom lines. Rather than elastic straps, suitably disposed thumb screws 59 provide means for locking the components in position with respect to one another.

FIG. 5 illustrates a perspective view of yet another modification of the invention.

Referring to the view of FIG. 5, a base member 71, a support member 72, a bookholder 73, and a transverse coupling member 74, together form the major components as before. The base member 71 comprises a paddle-like flat piece 75 which is pivotally mounted on the underside of a cross piece 76 comprising the coupling member 74. The support member 72 comprises four rods or tubes comprising legs 77, 78, 79 and 80 held parallel and spaced from one another by a support cross piece 81. The ends of legs 77–80 are held in suitable holes in cross member 76 and define a second planar surface. Bookholder 73 comprises a pair of clamping members 82, 83 with a thumb screw 84 for adjusting their position on legs 77–80. Bookholding ledges 85, 86 are mounted on the clamping member 82 so as to be perpendicular to the back rest for book 70, which back rest is formed by legs 77–80.

The paddle-shaped member 75 forming base member 71 may be clamped in the suspending mode position, as shown in solid lines, by a thumb screw 87, or it may be rotated to a table top supporting mode position, as indicated by dotted lines 75'. The appropriate included angles are as previously described between the plane formed by support legs 77–80 and the two positions 75, 75' of the base member.

FIG. 5 illustrates a perspective view of yet another modification of the invention.

Referring to the view of FIG. 5, a base member 71, a support member 72, a bookholder 73, and a transverse coupling member 74, together form the major components as before. The base member 71 comprises a paddle-like flat piece 75 which is pivotally mounted on the undersigned of a cross piece 76 comprising the coupling member 74. The support member 72 comprises four rods or tubes comprising legs 77, 78, 79 and 80 held parallel and spaced from one another by a support cross piece 81. The ends of legs 77–80 are held in suitable holes in cross member 76 and define a second planar surface. Bookholder 73 comprises a pair of clamping members 82, 83 with a thumb screw 84 for adjusting their position on legs 77–80. Bookholding ledges 84, 85 are mounted on the clamping member 82 so as to be perpendicular to the back rest for book 70, which back rest is formed by legs 77–80.

The paddle-shaped member 75 forming base member 71 may be clamped in the suspending mode position, as shown in solid lines, by a thumb screw 87, or it may be rotated to a table top supporting mode position, as indicated by dotted lines 75'. The appropriate included angles are as previously described between the plane formed by support legs 77–80 and the two positions 75, 75' of the base member.

Thus, there has been described what is considered to be the preferred embodiment of the invention, which utilizes simple and economical materials to provide an improved bookholder, having a dual position convertible base member without need for any additional parts. The overall bookholder may be employed either in a suspension mode supported by a mattress, or in a tabletop support mode. Furthermore, the bookholder member itself may be positioned on the bookholder support member either for holding the book at 45° for inclined reading or in a normal horizontal position. In this way four different combinations of support and reading modes may be achieved with the same components of the improved bookholder.

While there has been described what is considered to be the preferred embodiment of the invention, it is desired to secure in the appended claims all such modifications as fall within the true spirit and scope of the invention.

I claim:

1. An improved bookholder with a convertible base for dual support modes comprising:

a base member comprising a longitudinally extending base portion defining a first planar surface, and a U-shaped rod having at least two spaced parallel legs;

a support member having a longitudinally extending support portion defining a second planar surface;

a book carrier mounted on said support member and having book supporting ledges oriented substantially perpendicular to said second planar surface, whereby said second planar surface of said support member serves as a back rest for a book resting on said ledges;

a transverse coupling member defining a pair of spaced base holes for slidably receiving said spaced parallel legs, said transverse coupling member being arranged to receive and hold both said base member and said support member so that said first and second planar surfaces intersect at a selected included angle;

said book carrier being movable along said planar surface and having first locking means to fix its position so as to adjust the height of the book carrier; and said base member being movable with respect to the coupling member between a first suspending mode position when said selected included angle is between 90° and 130° and a second table support mode position when said selected included angle is respectively between 90° and 50°.

2. An improved bookholder with a convertible base for dual support modes comprising:

a base member having a longitudinally extending base portion defining a first planar surface;

a support member comprising a longitudinally extending support portion defining a second planar surface, and a U-shaped rod having at least two spaced parallel legs;

a book carrier mounted on said support member and having a book supporting ledges oriented substantially perpendicular to said second planar surface, whereby said second planar surface of said support member serves as a back rest for a book resting on said ledges;

a transverse coupling member defining a pair of spaced support holes for slidably receiving said spaced parallel legs, said transverse coupling member being arranged to receive and hold, both said base member and said support member so that said first and second planar surface intersect at a selected included angle;

said book carrier being movable along said planar surface and having first locking means to fix its position so as to adjust the height of the book carrier; and said base member being movable with respect to the coupling member between a first suspending mode position when said selected included angle is between 90° and 130° and a second table support mode position when said selected included angle is respectively between 90° and 50°.

3. An improved bookholder with a convertible base for dual support modes comprising:

a base member having a longitudinally extending base portion defining a first planar surface;

a support member comprising a longitudinally extending support portion defining a second planar surface, and a U-shaped rod having at least two spaced parallel legs;

a book carrier mounted on said support member and having a cross-piece connected to book supporting ledges, the latter of which are oriented substantially perpendicular to said second planar surface, said second planar surface of such support member serving as a back rest for a book resting on said ledges and said spaced parallel legs of said support member being slidably received in spaced parallel carrier holes defined by said book carrier such that said ledges will support a book in a first reading orientation;

a transverse coupling member defining a pair of spaced support holes for slidably receiving said spaced parallel legs, said transverse coupling member being arranged to receive and hold both said base member and said support member so that said first and second planar surface intersect at a selected included angle;

said book carrier being movable along said planar surface and having first locking means to fix its position so as to adjust the height of the book carrier; and said base member being movable with respect to the coupling member between a first suspending mode position when said selected included angle is between 90° and 130° and a second table support mode position when said selected included angle is respectively between 90° and 50.

4. An improved bookholder with a convertible base for dual support modes comprising:

a base member having a longitudinally extending base portion defining a first planar surface;

a support member comprising a longitudinally extending support portion defining a second planar surface, and a U-shaped rod having at least two spaced parallel legs;

a book carrier mounted on said support member and having a cross-piece connected to book supporting ledges, the latter of which are oriented substantially perpendicular to said second planar surface, said second planar surface of such support member serving as a back rest for a book resting on said ledges and said spaced parallel legs of said support member being slidably received in spaced parallel carrier holes defined by said book carrier such that said ledges will support a book in a first reading orientation;

a transverse coupling member defining a pair of spaced support holes for slidably receiving said spaced parallel legs, said transverse coupling member being arranged to receive and hold both said base member and said support member so that said first and second planar surface intersect at a selected included angle;

said book carrier being movable along said planar surface and having first locking means to fix its position so as to adjust the height of the book carrier;

said base member being movable with respect to the coupling member between a first suspending mode position when said selected included angle is between 90° and 130° and a second table support mode position when said selected included angle is respectively between 90° and 50°; and said cross piece including an additional pair of parallel spaced carrier holes arranged to slidably receive said support member legs such that said ledges will support a book in a second reading orientation.

5. An improved bookholder with a convertible base for dual support modes comprising:

a base member having a longitudinally extending base portion defining a first planar surface, and a U-shaped rod which has a pair of spaced longitudinally extending base member legs;

a support member having a longitudinally extending support portion defining a second planar surface, and a U-shaped rod which has a pair of spaced longitudinally extending support member legs;

a book carrier mounted on said support member and having book supporting ledges oriented substantially perpendicular to said second planar surface, whereby said second planar surface of said support member serves as a back rest for a book resting on said ledges;

a transverse coupling member defining a pair of spaced base holes for receiving said base member legs and further defining a pair of spaced support holes for receiving said support member legs, so that the planes containing the respective axes of said pairs of holes intersect at an included angle on the order of 110°;

said book carrier being movable along said planar surface and having first locking means to fix its position so as to adjust the height of the book carrier; and said base member being movable with respect to the coupling member between a first suspending mode position when said selected included angle is between 90° and 130° and a second table support mode position when said selected included angle is respectively between 90° and 50°.

6. An improved bookholder with a convertible base for dual support modes comprising:

a base member having a longitudinally extending base portion defining a first planar surface, and a U-shaped rod which has a pair of spaced longitudinally extending base member legs;

a support member having a longitudinally extending support portion defining a second planar surface, and a U-shaped rod which has a pair of spaced longitudinally extending support legs;

a book carrier mounted on said support member and having book supporting ledges oriented substantially perpendicular to said second planar surface, whereby said second planar surface of said support member serves as a back rest for a book resting on said ledges;

a transverse coupling member defining a pair of spaced base holes for receiving said base member legs and further defining a pair of spaced support holes for receiving said support member legs, so that the planes containing the respective axes of said pairs of holes intersect at an included angle on the order of 110°;

a plurality of elastic bands encircling said base member legs and said support member legs on opposite sides of the transverse coupling member, said elastic bands serving as means by which to lock the respective members in fixed position;

said book carrier being movable along said planar surface and having first locking means to fix its position so as to adjust the height of the book carrier; and said base member being movable with respect to the coupling member between a first suspending mode position when said selected included angle is between 90° and 130° and a second table support mode position when said selected included angle is respectively between 90° and 50.

7. An improved bookholder with a convertible base for dual support modes comprising, a base member including at least two transversely spaced longitudinally extending substantially straight base arms, a carrier member having at least two transversely spaced longitudinally extending substantially straight carrier arms, a transverse coupling member defining a first pair of holes adapted to receive said base member arms and a second pair of holes adapted to receive said carrier member arms at an included angle between base arms and carrier arms which lies between 90° and 130°, a bookholder member adapted for attachment to said support member and arranged to support a book or the like, said base member being convertible between a first longitudinally extending position on one side of said transverse coupling member when said included angle lies between 90° and 130° to provide a suspending mode support and movable to a second extending position on the other side of said transverse coupling member to provide an included angle between 90° and 50° so as to provide a table-top mode support, and means for locking said base member and said support member with respect to said transverse coupling member and for locking said bookholder member with respect to said support member.

* * * * *